US011460230B2

(12) United States Patent
Prins et al.

(10) Patent No.: US 11,460,230 B2
(45) Date of Patent: Oct. 4, 2022

(54) METHOD FOR CONTROLLING A VAPOUR COMPRESSION SYSTEM WITH A VARIABLE RECEIVER PRESSURE SETPOINT

(71) Applicant: Danfoss A/S, Nordborg (DK)

(72) Inventors: Jan Prins, Nordborg (DK); Frede Schmidt, Sonderborg (DK); Kenneth Bank Madsen, Ry (DK); Kristian Fredslund, Haderslev (DK)

(73) Assignee: Danfoss A/S, Nordborg (DK)

( * ) Notice: Subject to any disclaimer, the term of this patent is extended or adjusted under 35 U.S.C. 154(b) by 452 days.

(21) Appl. No.: 15/763,904

(22) PCT Filed: Oct. 14, 2016

(86) PCT No.: PCT/EP2016/074758
§ 371 (c)(1),
(2) Date: Mar. 28, 2018

(87) PCT Pub. No.: WO2017/067858
PCT Pub. Date: Apr. 27, 2017

(65) Prior Publication Data

US 2018/0283750 A1 Oct. 4, 2018

(30) Foreign Application Priority Data

Oct. 20, 2015 (DK) ..... PA 2015 00644

(51) Int. Cl.
*F25B 49/02* (2006.01)
*F25B 9/08* (2006.01)
(Continued)

(52) U.S. Cl.
CPC ..... *F25B 49/02* (2013.01); *F25B 9/08* (2013.01); *F25B 41/00* (2013.01); *F25B 41/385* (2021.01);
(Continued)

(58) Field of Classification Search
CPC .. F25B 9/08; F25B 41/00; F25B 49/02; F25B 2341/0661; F25B 2341/0012;
(Continued)

(56) References Cited

U.S. PATENT DOCUMENTS 1,836,318 A 12/1931 Gay
2,790,627 A 4/1957 Wakeman
(Continued)

FOREIGN PATENT DOCUMENTS

CN 2405181 Y 11/2000
CN 1309279 A 8/2001
(Continued)

OTHER PUBLICATIONS

Indian Office Action dated Jan. 27, 2020 for Appln. No. 201817003292.
(Continued)

*Primary Examiner* — Henry T Crenshaw
(74) *Attorney, Agent, or Firm* — McCormick, Paulding & Huber PLLC

(57) ABSTRACT

A method for controlling a vapour compression system (1) is disclosed, the vapour compression system (1) comprising at least one expansion device (8) and at least one evaporator (9). For each expansion device (8), an opening degree of the expansion device (8) is obtained, and a representative opening degree, $OD_{rep}$, is identified based on the obtained opening degree(s) of the expansion device(s) (8). The representative opening degree could be a maximum opening degree, $OD_{max}$, being the largest among the obtained opening degrees. The representative opening degree, $OD_{rep}$, is compared to a predefined target opening degree, $OD_{target}$, and a minimum setpoint value, $SP_{rec}$, for a pressure prevailing inside a receiver (7), is calculated or adjusted, based on the comparison. The vapour compression system (1) is controlled to obtain a pressure inside the receiver (7) which
(Continued)

is equal to or higher than the calculated or adjusted minimum setpoint value, $SP_{rec}$.

20 Claims, 6 Drawing Sheets

(51) Int. Cl.
*F25B 41/00* (2021.01)
*F25B 41/385* (2021.01)

(52) U.S. Cl.
CPC . *F25B 2341/0012* (2013.01); *F25B 2400/075* (2013.01); *F25B 2400/13* (2013.01); *F25B 2400/16* (2013.01); *F25B 2400/23* (2013.01); *F25B 2500/19* (2013.01); *F25B 2500/31* (2013.01); *F25B 2600/2501* (2013.01); *F25B 2600/2513* (2013.01); *F25B 2700/19* (2013.01)

(58) Field of Classification Search
CPC ..... F25B 2400/13; F25B 2400/23; F25B 2400/075; F25B 2400/16; F25B 2500/19; F25B 2500/31; F25B 2600/2513; F25B 2600/2501; F25B 2700/19
See application file for complete search history.

(56) References Cited

U.S. PATENT DOCUMENTS 3,788,394 A 1/1974 Derragon
3,792,730 A 2/1974 Andersson
4,067,203 A 1/1978 Behr
4,219,079 A 8/1980 Sumitomo
4,301,662 A 11/1981 Whitnah
4,420,373 A 12/1983 Egosi
4,432,415 A 2/1984 Wright
4,522,037 A 6/1985 Ares et al.
4,573,327 A 3/1986 Cochran
4,646,821 A 3/1987 Almqvist et al.
5,024,061 A 6/1991 Pfeil, Jr. et al.
5,226,320 A 7/1993 Dages et al.
5,553,457 A 9/1996 Reznikov
5,887,650 A 3/1999 Yang
6,305,187 B1 10/2001 Tsuboe et al.
6,698,221 B1 3/2004 You
6,786,056 B2 9/2004 Bash et al.
6,823,691 B2 11/2004 Ohta
7,178,359 B2 2/2007 Oshitani et al.
7,334,427 B2 2/2008 Ozaki et al.
7,389,648 B2 6/2008 Concha et al.
7,490,660 B2 2/2009 Song
7,844,366 B2 11/2010 Singh
8,887,524 B2 11/2014 Mihara
8,991,201 B2 3/2015 Ikegami et al.
9,217,590 B2 12/2015 Cogswell et al.
9,689,589 B2 6/2017 Minami et al.
9,752,801 B2 9/2017 Verma et al.
2001/0025499 A1 10/2001 Takeuchi et al.
2002/0124592 A1 9/2002 Takeuchi et al.
2003/0145613 A1 8/2003 Sakai et al.
2003/0209032 A1 11/2003 Ohta
2004/0003608 A1 1/2004 Takeuchi et al.
2004/0003615 A1 1/2004 Yamaguchi
2004/0007014 A1 1/2004 Takeuchi et al.
2004/0011065 A1 1/2004 Takeuchi et al.
2004/0040340 A1 3/2004 Takeuchi et al.
2004/0055326 A1* 3/2004 Ikegami ..... F04F 5/04 62/500
2004/0060316 A1 4/2004 Ito et al.
2004/0069011 A1 4/2004 Nishida et al.
2004/0079102 A1 4/2004 Umebayashi et al.
2004/0103685 A1 6/2004 Yamaguchi et al.
2004/0123624 A1 7/2004 Ohta et al.
2004/0211199 A1 10/2004 Ozaki et al.
2004/0255602 A1 12/2004 Sato et al.
2004/0255612 A1 12/2004 Nishijima et al.
2004/0255613 A1 12/2004 Choi et al.
2004/0261448 A1 12/2004 Nishijima et al.
2006/0236708 A1 10/2006 Mizuno et al.
2006/0254308 A1 11/2006 Yokoyama et al.
2006/0277932 A1 12/2006 Otake et al.
2008/0196873 A1 8/2008 Svensson
2009/0071177 A1 3/2009 Unezaki et al.
2009/0241569 A1 10/2009 Okada et al.
2009/0266093 A1 10/2009 Aoki
2010/0192607 A1 8/2010 Unezaki et al.
2010/0206539 A1 8/2010 Kim et al.
2010/0319393 A1 12/2010 Ikegami et al.
2011/0005268 A1 1/2011 Oshitani et al.
2011/0023515 A1 2/2011 Kopko et al.
2011/0041523 A1 2/2011 Taras et al.
2011/0197606 A1 8/2011 Zimmermann et al.
2011/0219803 A1 9/2011 Park et al.
2011/0239667 A1 10/2011 Won et al.
2011/0256005 A1 10/2011 Takeoka et al.
2011/0283723 A1 11/2011 Yakumaru
2011/0314854 A1 12/2011 Sata et al.
2012/0006041 A1 1/2012 Ikeda et al.
2012/0060523 A1 3/2012 Hung
2012/0151948 A1 6/2012 Ogata et al.
2012/0167601 A1 7/2012 Cogswell et al.
2012/0180510 A1 7/2012 Okazaki et al.
2012/0247146 A1 10/2012 Yamada et al.
2012/0324911 A1 12/2012 Shedd
2013/0042640 A1 2/2013 Higashiiue et al.
2013/0111935 A1 5/2013 Zou et al.
2013/0111944 A1 5/2013 Wang et al.
2013/0125569 A1 5/2013 Verma et al.
2013/0174590 A1 7/2013 Sjoholm et al.
2013/0251505 A1 9/2013 Wang et al.
2014/0208785 A1 7/2014 Wallace et al.
2014/0326018 A1 11/2014 Ignatiev
2014/0345318 A1 11/2014 Nagano et al.
2015/0300706 A1 10/2015 Awa et al.
2015/0330691 A1 11/2015 McSweeney
2016/0109160 A1 4/2016 Junge et al.
2016/0169565 A1 6/2016 Yokoyama et al.
2016/0169566 A1 6/2016 Nakashima et al.
2016/0186783 A1 6/2016 Nishijima et al.
2016/0280041 A1 9/2016 Suzuki et al.
2017/0159977 A1 6/2017 Hellmann
2017/0321941 A1 11/2017 Fredslund et al.
2017/0343245 A1 11/2017 Fredslund et al.
2018/0023850 A1 1/2018 Chaudhry et al.
2018/0066872 A1 3/2018 Hellmann
2018/0119997 A1 5/2018 Siegert et al.
2018/0142927 A1 5/2018 Hellmann et al.
2018/0274821 A1 9/2018 Lee et al.
2018/0283750 A1 10/2018 Prins et al.
2018/0320944 A1 11/2018 Prins et al.

FOREIGN PATENT DOCUMENTS

CN 1374491 A 10/2002
CN 1776324 A 5/2006
CN 1892150 A 1/2007
CN 101329115 A 12/2008
CN 101512255 A 8/2009
CN 101922823 A 12/2010
CN 102128508 A 7/2011
CN 201992750 U 9/2011
CN 202254492 U 5/2012
CN 202304070 U 7/2012
CN 103003641 A 3/2013
CN 103282730 A 9/2013
CN 103292623 A 9/2013
CN 104359246 A 2/2015
CN 104697234 A 6/2015
CN 207050547 U 2/2018
DE 4303669 C1 1/1994
DE 10029999 A1 1/2002
DE 10321191 A1 11/2003
EP 0005825 A1 5/1979
EP 0217605 A2 4/1987

(56) References Cited

FOREIGN PATENT DOCUMENTS

| | | | | |
|---|---|---|---|---|
| EP | 1236959 | A2 | 9/2002 | |
| EP | 1731853 | A2 * | 12/2006 | ..... F25B 9/008 |
| EP | 1731853 | A2 | 12/2006 | |
| EP | 2068094 | A1 | 6/2009 | |
| EP | 2068094 | A1 * | 6/2009 | ..... F25B 9/008 |
| EP | 2 077 427 | A1 | 7/2009 | |
| EP | 2 175 212 | A1 | 4/2010 | |
| EP | 2 224 187 | A2 | 9/2010 | |
| EP | 2504640 | A2 | 10/2012 | |
| EP | 3032208 | A1 | 6/2016 | |
| EP | 2718642 | B1 | 9/2016 | |
| EP | 3098543 | A1 | 11/2016 | |
| FR | 2844036 | A1 | 3/2004 | |
| GB | 2164439 | A | 3/1986 | |
| JP | H04316962 | A | 11/1992 | |
| JP | H04320762 | A | 11/1992 | |
| JP | 2001221517 | A | 8/2001 | |
| JP | 2005249315 | A | 9/2005 | |
| JP | 2009097786 | A | 5/2009 | |
| JP | 2010151424 | A | 7/2010 | |
| JP | 2014077579 | A | 5/2014 | |
| KR | 100196779 | B1 | 6/1999 | |
| KR | 20080006585 | U | 12/2008 | |
| RU | 2368850 | C2 | 9/2009 | |
| RU | 2415307 | C1 | 3/2011 | |
| RU | 2555087 | C1 | 7/2015 | |
| SU | 996805 | A1 | 2/1983 | |
| WO | 2012012488 | A1 | 1/2012 | |
| WO | 2012012493 | A2 | 1/2012 | |
| WO | 2012012501 | A2 | 1/2012 | |
| WO | 2012168544 | A1 | 12/2012 | |
| WO | 2014106030 | A1 | 7/2014 | |
| WO | 2016034298 | A1 | 3/2016 | |

OTHER PUBLICATIONS

International Search Report for Application No. PCT/EP2016/074758 dated Jan. 17, 2017.

International Search Report for Application No. PCT/EP2016/074774 dated Jan. 9, 2017.

International Search Report for Application No. PCT/EP2016/074765 dated Jan. 9, 2017.

International Search Report for PCT Serial No. PCT/EP2018/057515 dated Jun. 20, 2018.

European Examination Report for Serial No. 16 781 477.1 dated Feb. 21, 2019.

Danish Search Report for Serial No. PA 2015 00644 dated May 17, 2016.

Japanese Office Action and English Translation for Serial No. 2018-506946 dated May 12, 2020.

Partial European Search Report for Serial No. 19201243.3 dated Feb. 24, 2020.

International Search Report for PCT Serial No. PCT/EP2015/064019 dated Dec. 14, 2015.

International Search Report for PCT Serial No. PCT/EP2015/073211 dated Jan. 20, 2016.

International Search Report for Application No. PCT/EP2016/065575 dated Oct. 13, 2016.

International Search Report for PCT Serial No. PCT/EP2015/073171 dated Jan. 20, 2016.

Chinese Office Action and English Translation for Serial No. 201580060854.1 dated Jan. 4, 2019.

Taguchi, Air Conditioning System, Apr. 8, 1987, EP0217605A2, Whole Document (Year: 1987).

* cited by examiner

METHOD FOR CONTROLLING A VAPOUR COMPRESSION SYSTEM WITH A VARIABLE RECEIVER PRESSURE SETPOINT

CROSS-REFERENCE TO RELATED APPLICATIONS

This application is a National Stage application of International Patent Application No. PCT/EP2016/074758, filed on Oct. 14, 2016, which claims priority to Danish Patent Application No. PA 2015 00644, filed on Oct. 20, 2015, each of which is hereby incorporated by reference in its entirety.

FIELD OF THE INVENTION

The present invention relates to a method for controlling a vapour compression system, such as a refrigeration system, an air condition system, a heat pump, etc. The method according to the invention allows the vapour compression system to be operated in an energy efficient manner, without compromising safety of the vapour compression system.

BACKGROUND

In some refrigeration systems, a high pressure valve and/or an ejector is arranged in a refrigerant path, at a position downstream relative to a heat rejecting heat exchanger. Thereby refrigerant leaving the heat rejecting heat exchanger passes through the high pressure valve or the ejector, and the pressure of the refrigerant is thereby reduced. Furthermore, the refrigerant leaving the high pressure valve or the ejector will normally be in the form of a mixture of liquid and gaseous refrigerant, due to the expansion taking place in the high pressure valve or the ejector. This is, e.g., relevant in vapour compression systems in which a transcritical refrigerant, such as $CO_2$, is applied, and where the pressure of refrigerant leaving the heat rejecting heat exchanger is expected to be relatively high.

In such vapour compression systems, a receiver is sometimes arranged between the high pressure valve or ejector and an expansion device arranged to supply refrigerant to an evaporator. In the receiver, liquid refrigerant is separated from gaseous refrigerant. The liquid refrigerant is supplied to the evaporator, via an expansion device, and the gaseous refrigerant may be supplied to a compressor unit. Thereby the gaseous part of the refrigerant is not subjected to the pressure drop introduced by the expansion device, and the work required in order to compress the refrigerant can therefore be reduced.

If the pressure inside the receiver is high, the work required by the compressors in order to compress the gaseous refrigerant received from the receiver is correspondingly low. On the other hand, a high pressure inside the receiver has an impact on the liquid/gas ratio of the refrigerant in the receiver to the effect that less gaseous and more liquid refrigerant is present. Thereby the amount of available gaseous refrigerant in the receiver may not be sufficient to keep a compressor of the compressor unit, which receives gaseous refrigerant from the receiver, running. Furthermore, at low ambient temperatures, the efficiency of the vapour compression system is normally improved when the pressure inside the heat rejecting heat exchanger is relatively low.

US 2012/0167601 discloses an ejector cycle. A heat rejecting heat exchanger is coupled to a compressor to receive compressed refrigerant. An ejector has a primary inlet coupled to the heat rejecting heat exchanger, a secondary inlet and an outlet. A separator has an inlet coupled to the outlet of the ejector, a gas outlet and a liquid outlet. The system can be switched between first and second modes. In the first mode refrigerant leaving the heat absorbing heat exchanger is supplied to the secondary inlet of the ejector. In the second mode refrigerant leaving the heat absorbing heat exchanger is supplied to the compressor.

SUMMARY

It is an object of embodiments of the invention to provide a method for controlling a vapour compression system in an energy efficient manner, even at low ambient temperatures.

It is a further object of embodiments of the invention to provide a method for controlling a vapour compression system, in which the method enables one or more receiver compressors to operate at lower ambient temperatures than prior art methods.

The invention provides a method for controlling a vapour compression system, which is directed toward a vapour compression system comprising a compressor unit that comprises one or more compressors, a heat rejecting heat exchanger, a receiver, at least one expansion device and at least one evaporator arranged in a refrigerant path, each expansion device being arranged to control a supply of refrigerant to an evaporator, the method comprising the steps of:

- for each expansion device, obtaining an opening degree of the expansion device,
- identifying a representative opening degree, $OD_{rep}$, based on the obtained opening degree(s) of the expansion device(s),
- comparing the representative opening degree, $OD_{rep}$, to a predefined target opening degree, $OD_{target}$,
- calculating or adjusting a minimum setpoint value, $SP_{rec}$, for a pressure prevailing inside the receiver, based on the comparison, and controlling the vapour compression system to obtain a pressure inside the receiver which is equal to or higher than the calculated or adjusted minimum setpoint value, $SP_{rec}$.

The method according to the invention is for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, a receiver, at least one expansion device and at least one evaporator arranged in a refrigerant path. Each expansion device is arranged to control a supply of refrigerant to an evaporator. The heat rejecting heat exchanger could, e.g., be in the form of a condenser, in which refrigerant is at least partly condensed, or in the form of a gas cooler, in which refrigerant is cooled, but remains in a gaseous or trans-critical state. The expansion device(s) could, e.g., be in the form of expansion valve(s).

Thus, refrigerant flowing in the refrigerant path is compressed by the compressor(s) of the compressor unit. The compressed refrigerant is supplied to the heat rejecting heat exchanger, where heat exchange takes place with the ambient, or with a secondary fluid flow across the heat rejecting heat exchanger, in such a manner that heat is rejected from the refrigerant flowing through the heat rejecting heat exchanger. In the case that the heat rejecting heat exchanger is in the form of a condenser, the refrigerant is at least partly condensed when passing through the heat rejecting heat exchanger. In the case that the heat rejecting heat exchanger is in the form of a gas cooler, the refrigerant flowing through the heat rejecting heat exchanger is cooled, but it remains in a gaseous or trans-critical state.

From the heat rejecting heat exchanger, the refrigerant may pass through a high pressure valve or an ejector. Thereby the pressure of the refrigerant is reduced, and the refrigerant leaving a high pressure valve or an ejector will normally be in the form of a mixture of liquid and gaseous refrigerant, due to the expansion taking place in the high pressure valve or the ejector.

The refrigerant is then supplied to the receiver, where the refrigerant is separated into a liquid part and a gaseous part. The liquid part of the refrigerant is supplied to the expansion device(s), where expansion takes place and the pressure of the refrigerant is reduced, before the refrigerant is supplied to the evaporator(s). Each expansion device supplies refrigerant to a specific evaporator, and therefore the refrigerant supply to each evaporator can be controlled individually by controlling the corresponding expansion device. The refrigerant being supplied to the evaporator(s) is thereby in a mixed gaseous and liquid state. In the evaporator(s), the liquid part of the refrigerant is at least partly evaporated, while heat exchange takes place with the ambient, or with a secondary fluid flow across the evaporator(s), in such a manner that heat is absorbed by the refrigerant flowing through the evaporator(s). Finally, the refrigerant is supplied to the compressor unit.

The gaseous part of the refrigerant in the receiver may be supplied to the compressor unit. Thereby the gaseous part of the refrigerant is not subjected to the pressure drop introduced by the expansion device(s), and energy is conserved, as described above.

Thus, at least part of the refrigerant flowing in the refrigerant path is alternatingly compressed by the compressor(s) and expanded by the expansion device(s), while heat exchange takes place at the heat rejecting heat exchanger and at the evaporator(s). Thereby heating or cooling of one or more volumes can be obtained.

According to the method of the invention, an opening degree of each expansion device is obtained. This information may be readily available in a controller controlling the opening degrees(s) of the expansion device(s). Alternatively, the opening degree(s) may be measured or estimated. In the case that the vapour compression system comprises two or more evaporators and two or more expansion devices, the opening degrees of all of the expansion devices may be obtained substantially simultaneously, or at least in such a manner that all of the opening degrees have been determined before the representative opening degree is identified, as described below.

Next, a representative opening degree, $OD_{rep}$, is identified, based on the obtained opening degree(s) of the expansion device(s). The representative opening degree, $OD_{rep}$, may be the largest opening degree, the smallest opening degree, an average opening degree, a distribution of the opening degree(s), etc. In any event, the representative opening degree, $OD_{rep}$, represents an opening degree or a distribution of the opening degrees of the expansion device(s) of the vapour compression system. In the case that the vapour compression system comprises only one expansion device and one evaporator, the representative opening degree, $OD_{rep}$, will simply be the opening degree of this expansion device.

The representative opening degree, $OD_{rep}$, is then compared to a predefined target opening degree, $OD_{target}$. The target opening degree, $OD_{target}$, could, e.g., be an opening degree value which it is desirable to obtain for the representative opening degree, $OD_{rep}$. Alternatively, the target opening degree, $OD_{target}$, could be an upper threshold value or a lower threshold value for the representative opening degree, $OD_{rep}$.

Based on the comparison, a minimum setpoint value, $SP_{rec}$, for a pressure prevailing inside the receiver is calculated or adjusted. Thus, an absolute value of the minimum setpoint value, $SP_{rec}$, may be calculated. Alternatively, the comparison may merely reveal whether the minimum setpoint value, $SP_{rec}$, must be adjusted to a higher or a lower value.

Finally, the vapour compression system is controlled to obtain a pressure inside the receiver which is equal to or higher than the calculated or adjusted minimum setpoint value, $SP_{rec}$.

Accordingly, the minimum setpoint value, $SP_{rec}$, constitutes a lower boundary for the allowable pressure inside the receiver. However, since the minimum setpoint value, $SP_{rec}$, is calculated or adjusted as described above, it is not a fixed value, but is instead varied according to prevailing operating conditions and other system parameters. For instance, the minimum setpoint value, $SP_{rec}$, can be lowered, thereby allowing the pressure inside the receiver to be controlled to a lower level, if the prevailing operating conditions allow this. As described above, this will increase the available amount of gaseous refrigerant in the receiver to a level which is sufficient to keep a compressor receiving gaseous refrigerant from the receiver to keep running. This allows the energy conservation described above to be obtained during a larger portion of the total operating time, for instance during periods with lower ambient temperature.

It is an advantage that the minimum setpoint value, $SP_{rec}$, is calculated or adjusted based on the comparison between the representative opening degree, $OD_{rep}$, and the target opening degree, $OD_{target}$, because this comparison provides information regarding the present deviation between the representative opening degree, $OD_{rep}$, and the target opening degree, $OD_{target}$, i.e. information regarding 'how far' the representative opening degree, $OD_{rep}$, is from the target opening degree, $OD_{target}$. Based on this, it can be determined whether or not the minimum setpoint value, $SP_{rec}$, can be safely adjusted without compromising other aspects of the control of the vapour compression system. For instance, it is ensured that the expansion device(s) can be operated appropriately in order to meet a required cooling demand at each evaporator.

The step of identifying a representative opening degree, $OD_{rep}$, may comprise identifying a maximum opening degree, $OD_{max}$, as the largest opening degree among the obtained opening degree(s) of the expansion device(s). According to this embodiment, the representative opening degree, $OD_{rep}$, is simply selected as the opening degree of the expansion device which has the largest opening degree. Thereby it is the expansion device having the largest opening degree which 'decides' whether or not the minimum setpoint value, $SP_{rec}$, can be safely adjusted, such as whether or not it is safe to allow the pressure prevailing inside the receiver to reach a lower value than is presently allowed.

A mass flow through one of the expansion devices of the vapour compression system described herein is determined by the following equation:

$$\dot{m}=\sqrt{\Delta p}\cdot k\cdot OD,$$

where $\dot{m}$ is the mass flow through the expansion device, $\Delta p$ is the pressure difference across the expansion device, i.e. $p_{rec}-p_e$, where $p_{rec}$ is the pressure prevailing inside the receiver and $p_e$ is the evaporator sure or the suction pressure, k is a constant relating to characteristics of the expansion device and the density of the refrigerant, and OD is the opening degree of the expansion device. Accordingly, when the pressure prevailing inside the receiver is low, the pressure difference, $\Delta p$, across the expansion device is small. Therefore, in order to obtain a given mass flow, $\dot{m}$, through the expansion device, it may be necessary to select a relatively large opening degree, OD, of the expansion device. If the opening degree, OD, is already close to the maximum opening degree of the expansion device, i.e. if the expansion device is almost fully open, it will not be possible to increase the mass flow through the expansion device by increasing the opening degree. Instead, the pressure difference, $\Delta p$, can be increased by increasing the pressure, $p_{rec}$, prevailing inside the receiver. When this situation occurs, it may therefore be appropriate to increase the minimum setpoint value, $SP_{rec}$.

On the other hand, if the opening degree, OD, of the expansion device is significantly lower than the maximum opening degree of the expansion device, it is possible to increase the opening degree, OD, in order to increase the mass flow through the expansion device, even if the pressure, $p_{rec}$, prevailing inside the receiver, and thereby the pressure difference, $\Delta p$, across the expansion device, is reduced. Therefore, in this case it is safe to decrease the minimum setpoint value, $SP_{rec}$, thereby allowing the pressure inside the receiver to reach a lower level.

According to this embodiment of the invention, the expansion device having the largest opening degree, $OD_{max}$, is allowed to 'decide' whether or not it is safe to reduce the minimum setpoint value, $SP_{rec}$, and/or whether or not it is necessary to increase the minimum setpoint value, $SP_{rec}$. Thereby it is ensured that none of the expansion devices end up in a situation where it is not possible to increase the mass flow through the expansion device by increasing the opening degree of the expansion device. Thereby it is ensured that the pressure prevailing inside the receiver can be kept at a low level, while ensuring that each evaporator receives a sufficient refrigerant supply to meet a required cooling demand.

The step of calculating or adjusting a minimum setpoint value, $SP_{rec}$, may comprise reducing the minimum setpoint value, $SP_{rec}$, in the case that the representative opening degree, $OD_{rep}$, is smaller than the target opening degree, $OD_{target}$. According to this embodiment, the target opening degree, $OD_{target}$, may e.g., represent an upper boundary for a desirable range of the representative opening degree, $OD_{rep}$.

In the case that the representative opening degree, $OD_{rep}$, is the maximum opening degree, $OD_{max}$, as described above, then the target opening degree, $OD_{target}$, may represent an opening degree, above which it becomes difficult to increase the mass flow through the expansion device by increasing the opening degree of the expansion device. However, as long as the maximum opening degree, $OD_{max}$, is below the target opening degree, $OD_{target}$, it is still safe to reduce the minimum setpoint value, $SP_{rec}$.

Similarly, the step of calculating or adjusting a minimum setpoint value, $SP_{rec}$, may comprise increasing the minimum setpoint value, $SP_{rec}$, in the case that the representative opening degree, $OD_{rep}$, is larger than the target opening degree, $OD_{target}$.

Similarly to the situation described above, in the case that the representative opening degree, $OD_{rep}$, is the maximum opening degree, $OD_{max}$, it may be necessary to increase the minimum setpoint value, $SP_{rec}$, if the maximum opening degree, $OD_{max}$, is larger than the target opening degree, $OD_{target}$, in order to ensure that all of the expansion devices are able to react to an increased cooling demand.

A gaseous outlet of the receiver may be connected to an inlet of the compressor unit, via a bypass valve, and the step of controlling the vapour compression system may comprise controlling the pressure prevailing inside the receiver by operating the bypass valve. According to this embodiment, the pressure prevailing inside the receiver is controlled by controlling the flow of gaseous refrigerant from the receiver to the compressor unit, by means of the bypass valve.

The compressor unit may comprise one or more main compressors connected between an outlet of the evaporator(s) and an inlet of the heat rejecting heat exchanger, and one or more receiver compressors connected between a gaseous outlet of the receiver and an inlet of the heat rejecting heat exchanger, and the step of controlling the vapour compression system may comprise controlling the pressure prevailing inside the receiver by controlling a refrigerant supply to the receiver compressor(s).

According to this embodiment, each of the compressors of the compressor unit receives refrigerant either from the outlet(s) of the evaporator(s) or from the gaseous outlet of the receiver. Each of the compressors may be permanently connected to the outlet(s) of the evaporator(s) or to the gaseous outlet of the receiver. Alternatively, at least some of the compressors may be provided with a valve arrangement allowing the compressor to be selectively connected to the outlet(s) of the evaporator(s) or to the gaseous outlet of the receiver. In this case the available compressor capacity can be distributed in a suitable manner between 'main compressor capacity' and 'receiver compressor capacity', by appropriately operating the valve arrangement(s).

The supply of refrigerant to the receiver compressor(s) could, e.g., be adjusted by switching one or more compressors between being connected to the outlet(s) of the evaporator(s) and being connected to the gaseous outlet of the receiver. As an alternative, the compressor speed of one or more receiver compressors could be adjusted. As another alternative, one or more receiver compressors could be switched on or off. Finally, the supply of refrigerant to the receiver compressor(s) could be adjusted by controlling a valve arranged in the refrigerant path interconnecting the gaseous outlet of the receiver and the receiver compressor(s) and/or a bypass valve arranged in the refrigerant path interconnecting the gaseous outlet of the receiver and the main compressor(s).

The vapour compression system may further comprise an ejector, an outlet of the heat rejecting heat exchanger being connected to a primary inlet of the ejector, an outlet of the ejector being connected to the receiver, and an outlet of the evaporator(s) being connected to an inlet of the compressor unit and to a secondary inlet of the ejector.

According to this embodiment, refrigerant leaving the heat rejecting heat exchanger is supplied to a primary inlet of the ejector, and at least some of the refrigerant leaving an evaporator of the vapour compression system may be supplied to a secondary inlet of the ejector.

An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described above will cause the refrigerant to perform work, and thereby the power consumption of the vapour compression system is reduced as compared to the situation where no ejector is provided.

It is desirable to operate the vapour compression system in such a manner that as large a portion as possible of the refrigerant leaving the evaporator is supplied to the secondary inlet of the ejector, and the refrigerant supply to the compressor unit is primarily provided from the gaseous outlet of the receiver, because this is the most energy efficient way of operating the vapour compression system.

At high ambient temperatures, such as during the summer period, the temperature as well as the pressure of the refrigerant leaving the heat rejecting heat exchanger is relatively high. In this case the ejector performs well, and it is advantageous to supply all of the refrigerant leaving the evaporator to the secondary inlet of the ejector, and to supply gaseous refrigerant to the compressor unit from the receiver only. When the vapour compression system is operated in this manner, it is sometimes referred to as 'summer mode'.

On the other hand, at low ambient temperatures, such as during the winter period, the temperature as well as the pressure of the refrigerant leaving the heat rejecting heat exchanger is relatively low. In this case the ejector is not performing well, and refrigerant leaving the evaporator is therefore often supplied to the compressor unit instead of to the secondary inlet of the ejector. This is due to the fact that the low pressure of refrigerant leaving the heat rejecting heat exchanger results in a small pressure difference across the ejector, thereby reducing the ability of the primary flow through the ejector to drive the secondary flow through the ejector. When the vapour compression system is operated in this manner, it is sometimes referred to as 'winter mode'. As described above, this is a less energy efficient way of operating the vapour compression system, and it is therefore desirable to operate the vapour compression system in the 'summer mode', i.e. with the ejector operating, at as low ambient temperatures as possible.

When operating the vapour compression system according to the method of the invention, the pressure prevailing inside the receiver is allowed to decrease to a very low level, as long as this is not adversely affecting other aspects of the control of the vapour compression system. This increases the pressure difference across the ejector, thereby improving the ability of the primary flow through the ejector to drive the secondary flow through the ejector. Furthermore, the pressure difference between the evaporator pressure or suction pressure and the pressure prevailing inside the receiver is decreased. This even further improves the ability of the primary flow through the ejector to drive the secondary flow through the ejector. As a consequence, the method of the invention allows the ejector to operate at lower ambient temperatures, thereby improving the energy efficiency of the vapour compression system.

BRIEF DESCRIPTION OF THE DRAWINGS

The invention will now be described in further detail with reference to the accompanying drawings in which.

DETAILED DESCRIPTION

Figure 1:
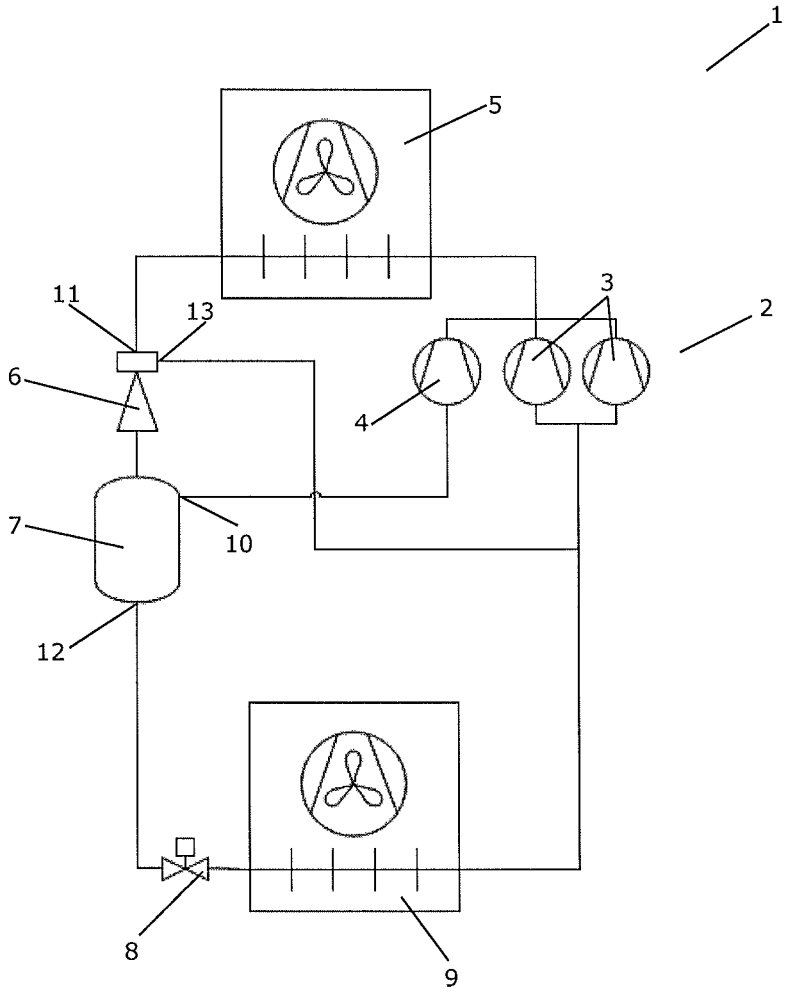
FIG. 1 is a diagrammatic view a vapour compression system being controlled in accordance with a method according to a first embodiment of the invention.

FIG. 1 is a diagrammatic view of a vapour compression system 1 being controlled in accordance with a method according to a first embodiment of the invention. The vapour compression system 1 comprises a compressor unit 2 comprising a number of compressors 3, 4, three of which are shown, a heat rejecting heat exchanger 5, an ejector 6, a receiver 7, an expansion device 8, and an evaporator 9 arranged in a refrigerant path.

Two of the shown compressors 3 are connected to an outlet of the evaporator 9. Accordingly, refrigerant leaving the evaporator 9 can be supplied to these compressors 3. The third compressor 4 is connected to a gaseous outlet 10 of the receiver 7. Accordingly, gaseous refrigerant can be supplied directly from the receiver 7 to this compressor 4.

Refrigerant flowing in the refrigerant path is compressed by the compressors 3, 4 of the compressor unit 2. The compressed refrigerant is supplied to the heat rejecting heat exchanger 5, where heat exchange takes place in such a manner that heat is rejected from the refrigerant.

The refrigerant leaving the heat rejecting heat exchanger 5 is supplied to a primary inlet 11 of the ejector 6, before being supplied to the receiver 7. When passing through the ejector 6 the refrigerant undergoes expansion. Thereby the pressure of the refrigerant is reduced, and the refrigerant being supplied to the receiver 7 is in a mixed liquid and gaseous state.

In the receiver 7 the refrigerant is separated into a liquid part and a gaseous part. The liquid part of the refrigerant is supplied to the evaporator 9, via a liquid outlet 12 of the receiver 7 and the expansion device 8. In the evaporator 9, the liquid part of the refrigerant is at least partly evaporated, while heat exchange takes place in such a manner that heat is absorbed by the refrigerant.

The refrigerant leaving the evaporator 9 is either supplied to the compressors 3 of the compressor unit 2 or to a secondary inlet 13 of the ejector 6.

The vapour compression system 1 of FIG. 1 is operated in the most energy efficient manner when all of the refrigerant leaving the evaporator 9 is supplied to the secondary inlet 13 of the ejector 6, and the compressor unit 2 only receives refrigerant from the gaseous outlet 10 of the receiver 7. In this case only compressor 4 of the compressor unit 2 is operating, while compressors 3 are switched off. It is therefore desirable to operate the vapour compression system 1 in this manner for as large a part of the total operating time as possible. When the pressure prevailing inside the receiver 7 is low, a large portion of the refrigerant in the receiver 7 is in a gaseous state, and thereby a large amount of gaseous refrigerant is available for being supplied to the compressor 4. Therefore a low pressure level inside the receiver 7 is in general desirable. The vapour compression system 1 is controlled in accordance with a setpoint value for the pressure prevailing inside the receiver 7, and in such a manner that this setpoint value is maintained within an appropriate range between a minimum setpoint value and a maximum setpoint value. In the method according to the invention, the minimum setpoint value, $SP_{rec}$, is adjusted in order to allow the pressure inside the receiver 7 to decrease to a lower level when this is not disadvantageous with respect to other aspects of the control of the vapour compression system 1.

A mass flow through the expansion device 8 is determined by the following equation:

$$\dot{m}=\sqrt{\Delta p}\cdot k\cdot OD,$$

where $\dot{m}$ is the mass flow through the expansion device 8, $\Delta p$ is the pressure difference across the expansion device 8, i.e. $p_{rec}-p_e$, where $p_{rec}$ is the pressure prevailing inside the receiver 7 and $p_e$ is the evaporator pressure or the suction pressure, k is a constant relating to characteristics of the expansion device 8 and to the density of the refrigerant, and OD is the opening degree of the expansion device 8. Accordingly, when the pressure prevailing inside the receiver 7 is low, the pressure difference, $\Delta p$, across the expansion device 8 is small. Therefore, in order to obtain a given mass flow, $\dot{m}$, through the expansion device 8, it may be necessary to select a relatively large opening degree, OD, of the expansion device 8. If the opening degree, OD, is already close to the maximum opening degree of the expansion device 8, i.e. if the expansion device 8 is almost fully open, it will not be possible to increase the mass flow through the expansion device 8 by increasing the opening degree. Instead, the pressure difference, $\Delta p$, can be increased by increasing the pressure, $p_{rec}$, prevailing inside the receiver. When this situation occurs, it may therefore be appropriate to increase the minimum setpoint value, $SP_{rec}$.

On the other hand, if the opening degree, OD, of the expansion device 8 is significantly lower than the maximum opening degree of the expansion device 8, it is possible to increase the opening degree, OD, in order to increase the mass flow through the expansion device 8, even if the pressure, $p_{rec}$, prevailing inside the receiver 7, and thereby the pressure difference, $\Delta p$, across the expansion device 8, is reduced. Therefore, in this case it is safe to decrease the minimum setpoint value, $SP_{rec}$, thereby allowing the pressure inside the receiver 7 to reach a lower level.

Therefore, when controlling the vapour compression system 1 of FIG. 1, the opening degree, OD, of the expansion device 8 is obtained and compared to a target opening degree, $OD_{target}$. The target opening degree, $OD_{target}$, could advantageously be a relatively large opening degree, but sufficiently below the maximum opening degree of the expansion device 8 to allow the expansion device 8 to react to an increase in cooling demand by increasing the opening degree, OD, of the expansion device 8.

Based on the comparison, the minimum setpoint value, $SP_{rec}$, for the pressure prevailing inside the receiver 7 is calculated or adjusted, e.g. as described above. Subsequently, the vapour compression system 1 is controlled to obtain a pressure inside the receiver 7 which is equal to or higher than the calculated or adjusted minimum setpoint value, $SP_{rec}$. The pressure prevailing inside the receiver 7 may, e.g., be adjusted by adjusting the compressor capacity of compressor 4.

Figure 2:
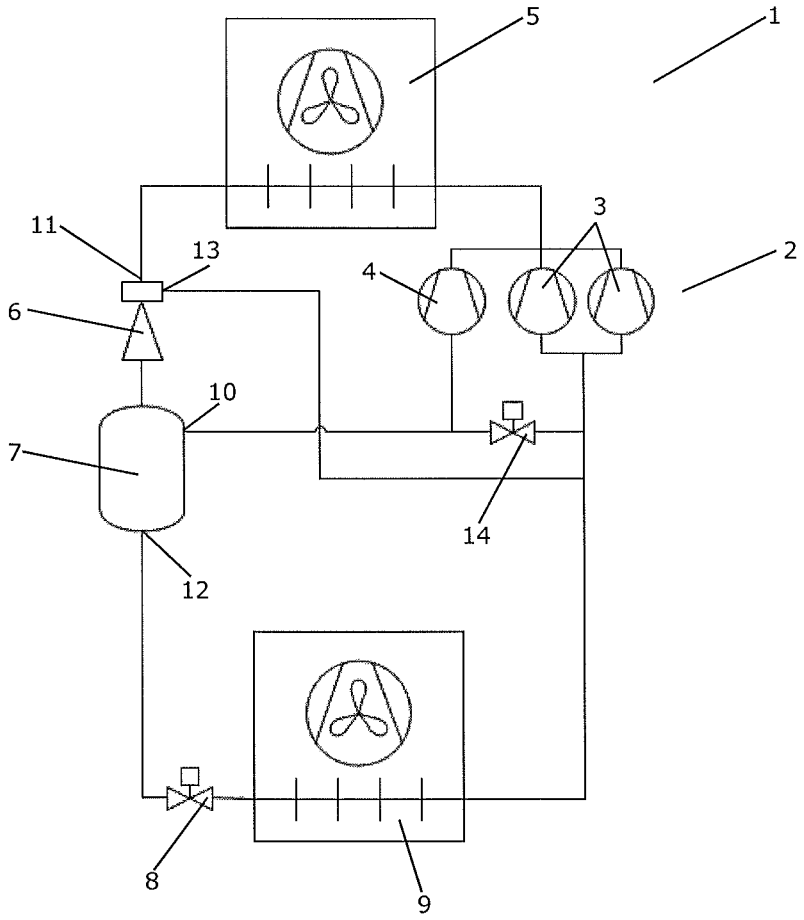
FIG. 2 is a diagrammatic view a vapour compression system being controlled in accordance with a method according to a second embodiment of the invention.

FIG. 2 is a diagrammatic view of a vapour compression system 1 being controlled in accordance with a method according to a second embodiment of the invention. The vapour compression system 1 of FIG. 2 is very similar to the vapour compression system 1 of FIG. 1, and it will therefore not be described in detail here.

In the vapour compression system 1 of FIG. 2, the gaseous outlet 10 of the receiver 7 is further connected to compressors 3, via a bypass valve 14. Thereby the pressure inside the receiver 7 may further be adjusted by operating the bypass valve 14, thereby controlling a refrigerant flow from the gaseous outlet 10 of the receiver 7 to the compressors 3.

Figure 3:
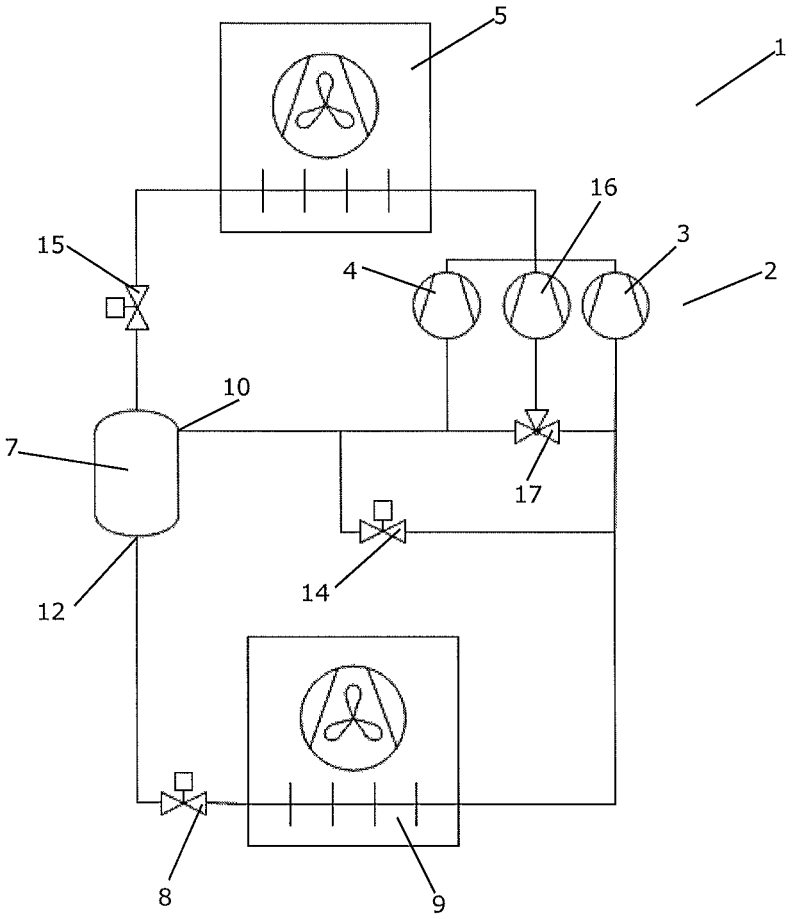
FIG. 3 is a diagrammatic view a vapour compression system being controlled in accordance with a method according to a third embodiment of the invention.

FIG. 3 is a diagrammatic view of a vapour compression system 1 being controlled in accordance with a method according to a third embodiment of the invention. The vapour compression system 1 of FIG. 3 is very similar to the vapour compression systems 1 of FIGS. 1 and 2, and it will therefore not be described in detail here.

In the vapour compression system 1 of FIG. 3 the ejector has been replaced by a high pressure valve 15. Thus, refrigerant leaving the heat rejecting heat exchanger 5 still undergoes expansion when passing through the high pressure valve 15, similarly to the situation described above with reference to FIG. 1. However, all of the refrigerant leaving the evaporator 9 is supplied to the compressor unit 2.

In the compressor unit 2, one compressor 3 is shown as being connected to the outlet of the evaporator 9 and one compressor 4 is shown as being connected to the gaseous outlet 10 of the receiver 7. A third compressor 16 is shown as being provided with a three way valve 17 which allows the compressor 16 to be selectively connected to the outlet of the evaporator 9 or to the gaseous outlet 10 of the receiver 7. Thereby some of the compressor capacity of the compressor unit 2 can be shifted between 'main compressor capacity', i.e. when the compressor 16 is connected to the outlet of the evaporator 9, and 'receiver compressor capacity', i.e. when the compressor 16 is connected to the gaseous outlet 10 of the receiver 7. Thereby it is further possible to adjust the pressure prevailing inside the receiver 7 by operating the three way valve 17, thereby increasing or decreasing the amount of compressor capacity being available for compressing refrigerant received from the gaseous outlet 10 of the receiver 7.

Figure 4:
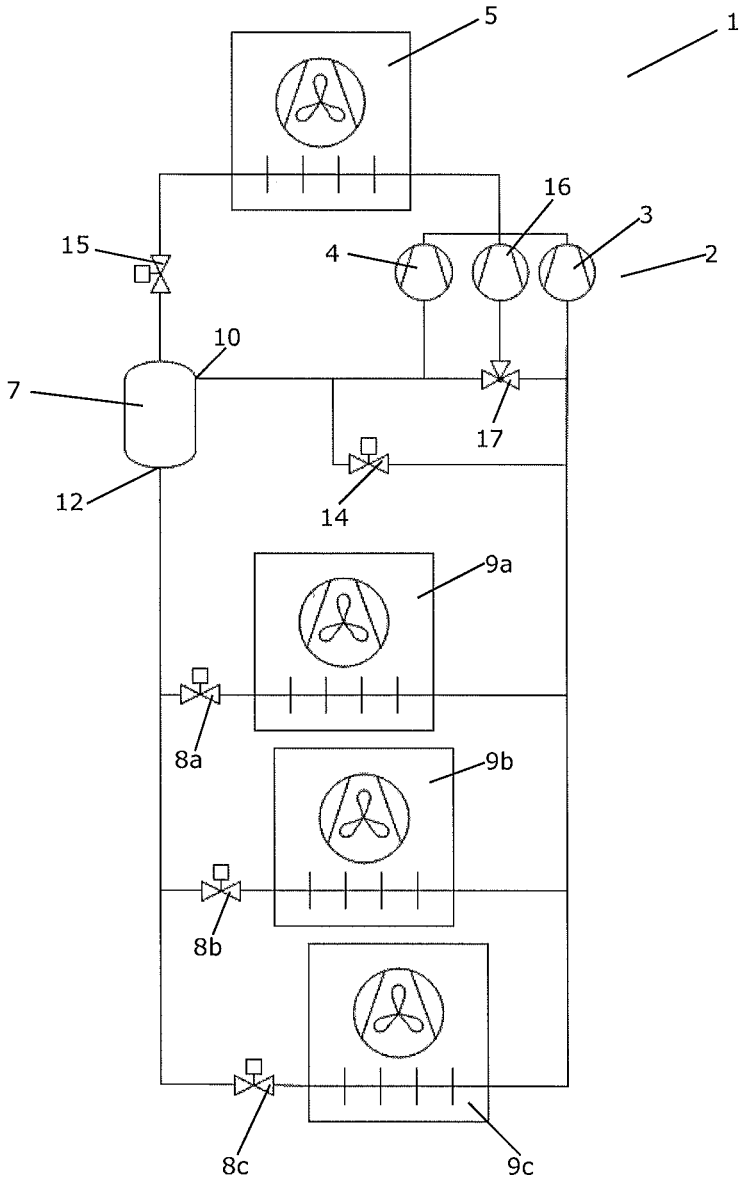
FIG. 4 is a diagrammatic view a vapour compression system being controlled in accordance with a method according to a fourth embodiment of the invention.

FIG. 4 is a diagrammatic view of a vapour compression system 1 being controlled in accordance with a method according to a fourth embodiment of the invention. The vapour compression system 1 of FIG. 4 is very similar to the vapour compression system 1 of FIG. 3, and it will therefore not be described in detail here.

The vapour compression system 1 of FIG. 4 comprises three evaporators 9*a*, 9*b*, 9*c* arranged in parallel in the refrigerant path. Each evaporator 9*a*, 9*b*, 9*c* has an expansion device 8*a*, 8*b*, 8*c* associated therewith, each expansion device 8*a*, 8*b*, 8*c* thereby controlling a supply of refrigerant to one of the evaporators 9*a*, 9*b*, 9*c*. Each evaporator 9*a*, 9*b*, 9*c* may, e.g., be arranged to provide cooling for a separate volume, e.g. in the form of separate display cases in a supermarket.

When controlling the vapour compression system 1 of FIG. 4 the opening degree of each of the expansion devices 8*a*, 8*b*, 8*c* is obtained. Then a representative opening degree, $OD_{rep}$, is identified, based on the obtained opening degrees of the expansion devices 8*a*, 8*b*, 8*c*. The representative opening degree, $OD_{rep}$, could, e.g., be a maximum opening degree, $OD_{max}$, being the largest of the opening degrees of the expansion devices 8*a*, 8*b*, 8*c*.

The representative opening degree, $OD_{rep}$, is then compared to a target opening degree, $OD_{target}$. Subsequently, the vapour compression system 1 is controlled essentially as described above with reference to FIG. 1.

Figure 5:
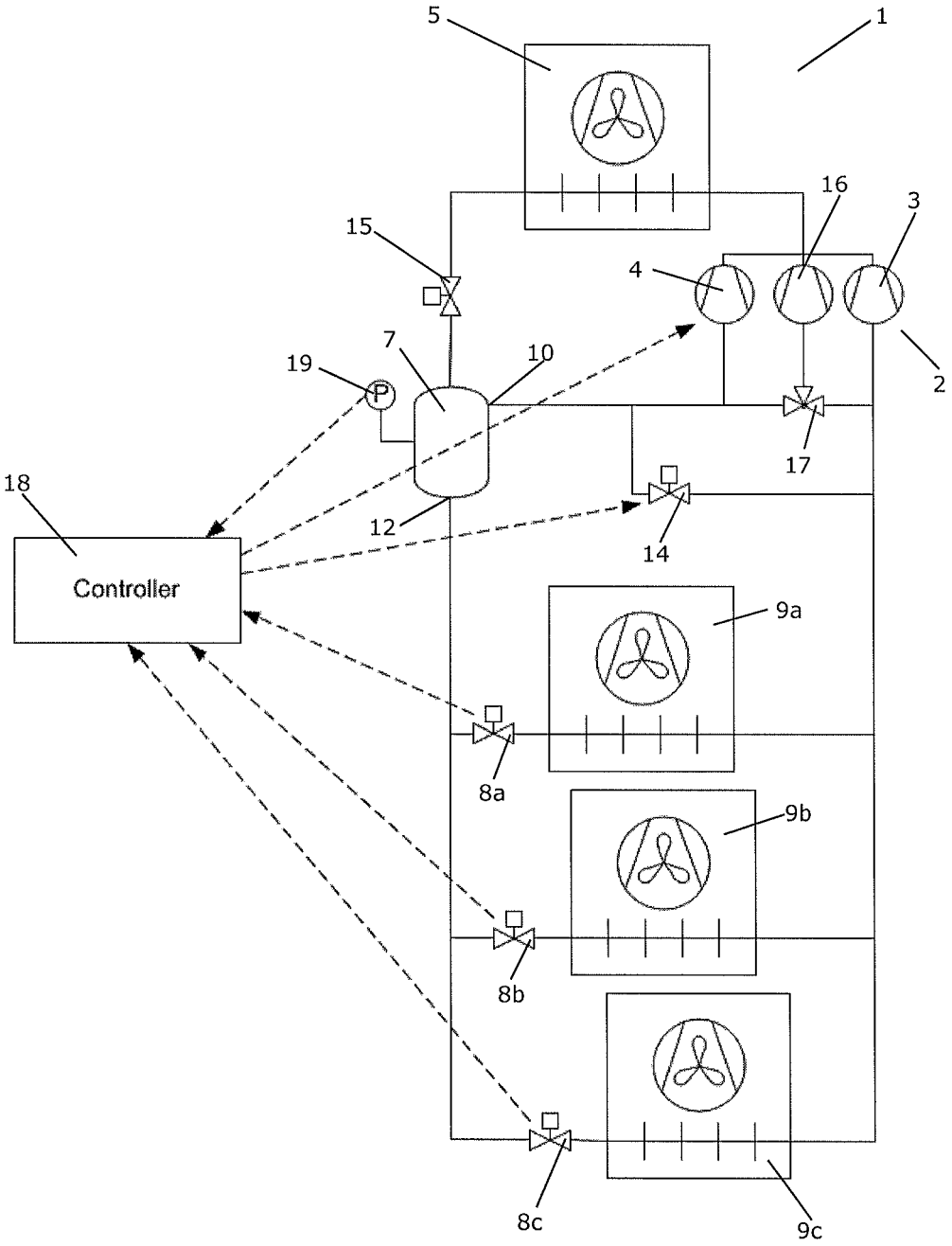
FIG. 5 illustrates control of the vapour compression system of FIG. 4.

FIG. 5 illustrates control of the vapour compression system 1 of FIG. 4. It can be seen that an opening degree is communicated from each expansion device 8*a*, 8*b*, 8*c* to a controller 18. In response thereto, the controller 18 identifies a representative opening degree, $OD_{rep}$, and compares the representative opening degree, $OD_{rep}$, to a predefined target opening degree, $OD_{target}$. Based on the comparison, the controller 18 calculates or adjusts a minimum setpoint value, $SP_{rec}$, for a pressure prevailing inside the receiver 7, essentially as described above. The calculated or adjusted minimum setpoint value, $SP_{rec}$, constitutes a lower limit for a setpoint value which is used for controlling the pressure prevailing inside the receiver 7.

Furthermore, the controller 18 may set a setpoint value for the pressure inside the receiver 7 and control the vapour compression system 1 in accordance therewith. To this end the controller 18 receives measurements from a pressure sensor 19 arranged to measure the pressure prevailing inside the receiver 7. Based on the received measurements of the pressure prevailing inside the receiver 7, the controller 18 generates control signals for the compressor 4 which is connected to the gaseous outlet 10 of the receiver 7 and/or to the bypass valve 14. Thereby the controller 18 causes the pressure prevailing inside the receiver 7 to be controlled in order to reach the setpoint value.

Figure 6:
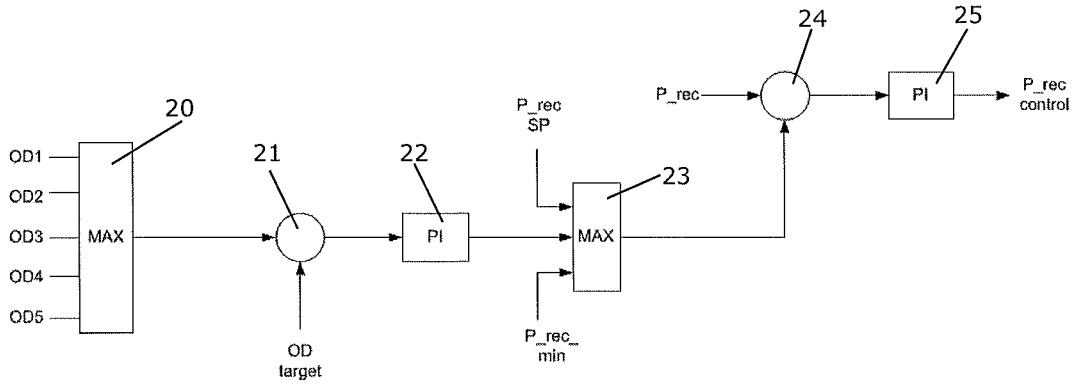
FIG. 6 is a block diagram illustrating a method according to an embodiment of the invention.

FIG. 6 is a block diagram illustrating a method according to an embodiment of the invention. Opening degrees, OD1, OD2, OD3, OD4, OD5 of five different expansion devices are provided to a first comparing block 20, where a maximum opening degree, $OD_{max}$, being the largest among the opening degrees, OD1, OD2, OD3, OD4 and OD5, is identified. The maximum opening degree, $OD_{max}$, is compared to a target opening degree, $OD_{target}$, at a first comparator 21. An error signal is generated, based on this comparison, and supplied to a first PI controller 22. The output of the first PI controller 22 is supplied to a second comparing block 23. The second comparing block 23 further receives a signal, P_rec_SP, which represents a setpoint value for the pressure prevailing inside the receiver, and a signal, P_rec_min, which represents a minimum setpoint value, constituting a lower boundary for the setpoint value for the pressure inside the receiver.

The second comparing block 23 selects the largest of the three received signals, and forwards this signal to a second comparator 24, where the signal is compared to a measured value, P_rec, of the pressure prevailing inside the receiver. The result of this comparison is supplied to a second PI controller 25, which in turn outputs a control signal in order to control the pressure prevailing inside the receiver.

Figure 7:
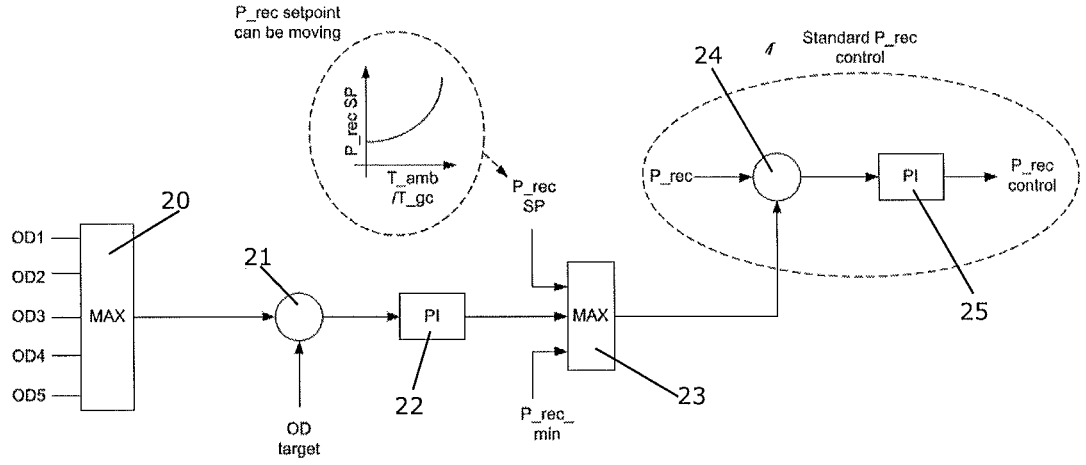
FIG. 7 is a block diagram illustrating a method according to an alternative embodiment of the invention.

FIG. 7 is a block diagram illustrating a method according to an alternative embodiment of the invention. The method illustrated in FIG. 7 is very similar to the method illustrated in FIG. 6, and it will therefore not be described in detail here.

In FIG. 7 it is illustrated that the setpoint, P_rec_SP for the pressure prevailing inside the receiver could be variable, e.g. on the basis of the prevailing operating conditions, such as the ambient temperature. It is further indicated that the last part of the process is simply a standard PI control of the pressure prevailing inside the receiver.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system, the vapour compression system comprising a compressor unit comprising one or more compressors, a heat rejecting heat exchanger, a receiver, at least one expansion device and at least one evaporator arranged in a refrigerant path, each expansion device of the at least one expansion device being arranged to control a supply of refrigerant to an evaporator of the at least one evaporator, the method comprising the steps of:

obtaining an opening degree of each expansion device of the at least one expansion device, identifying a representative opening degree, $OD_{rep}$, based on the obtained opening degree(s) of the at least one expansion device, comparing the representative opening degree, $OD_{rep}$, to a predefined target opening degree, $OD_{target}$, calculating or adjusting a minimum setpoint value, $SP_{rec}$, for a pressure prevailing inside the receiver, based on the comparison, and controlling the vapour compression system to obtain a pressure inside the receiver which is equal to or higher than the calculated or adjusted minimum setpoint value, $SP_{rec}$.

2. The method according to claim 1, wherein the step of identifying a representative opening degree, $OD_{rep}$, comprises identifying a maximum opening degree, $OD_{max}$, as the largest opening degree among the obtained opening degree(s) of the expansion device(s).

3. The method according to claim 1, wherein the step of calculating or adjusting a minimum setpoint value, $SP_{rec}$, comprises reducing the minimum setpoint value, $SP_{rec}$, in the case that the representative opening degree, $OD_{rep}$, is smaller than the target opening degree, $OD_{target}$.

4. The method according to claim 1, wherein the step of calculating or adjusting a minimum setpoint value, $SP_{rec}$, comprises increasing the minimum setpoint value, $SP_{rec}$, in the case that the representative opening degree, $OD_{rep}$, is larger than the target opening degree, $OD_{target}$.

5. The method according to claim 1, wherein a gaseous outlet of the receiver is connected to an inlet of the compressor unit via a bypass valve, and wherein the step of controlling the vapour compression system comprises controlling the pressure prevailing inside the receiver by operating the bypass valve.

6. The method according to claim 1, wherein the compressor unit comprises one or more main compressors connected between an outlet of the evaporator(s) and an inlet of the heat rejecting heat exchanger, and one or more receiver compressors connected between a gaseous outlet of the receiver and an inlet of the heat rejecting heat exchanger, and wherein the step of controlling the vapour compression system comprises controlling the pressure prevailing inside the receiver by controlling a refrigerant supply to the receiver compressor(s).

7. The method according to claim 1, wherein the vapour compression system further comprises an ejector, an outlet of the heat rejecting heat exchanger being connected to a primary inlet of the ejector, an outlet of the ejector being connected to the receiver, and an outlet of the at least one evaporator being connected to an inlet of the compressor unit and to a secondary inlet of the ejector.

8. The method according to claim 2, wherein the step of calculating or adjusting a minimum setpoint value, $SP_{rec}$, comprises reducing the minimum setpoint value, $SP_{rec}$, in the case that the representative opening degree, $OD_{rep}$, is smaller than the target opening degree, $OD_{target}$.

9. The method according to claim 2, wherein the step of calculating or adjusting a minimum setpoint value, $SP_{rec}$, comprises increasing the minimum setpoint value, $SP_{rec}$, in the case that the representative opening degree, $OD_{rep}$, is larger than the target opening degree, $OD_{target}$.

10. The method according to claim 3, wherein the step of calculating or adjusting a minimum setpoint value, $SP_{rec}$, comprises increasing the minimum setpoint value, $SP_{rec}$, in the case that the representative opening degree, $OD_{rep}$, is larger than the target opening degree, $OD_{target}$.

11. The method according to claim 2, wherein a gaseous outlet of the receiver is connected to an inlet of the compressor unit, via a bypass valve, and wherein the step of controlling the vapour compression system comprises controlling the pressure prevailing inside the receiver by operating the bypass valve.

12. The method according to claim 3, wherein a gaseous outlet of the receiver is connected to an inlet of the compressor unit, via a bypass valve, and wherein the step of controlling the vapour compression system comprises controlling the pressure prevailing inside the receiver by operating the bypass valve.

13. The method according to claim 4, wherein a gaseous outlet of the receiver is connected to an inlet of the compressor unit, via a bypass valve, and wherein the step of controlling the vapour compression system comprises controlling the pressure prevailing inside the receiver by operating the bypass valve.

14. The method according to claim 2, wherein the compressor unit comprises one or more main compressors connected between an outlet of the evaporator(s) and an inlet of the heat rejecting heat exchanger, and one or more receiver compressors connected between a gaseous outlet of the receiver and an inlet of the heat rejecting heat exchanger, and wherein the step of controlling the vapour compression system comprises controlling the pressure prevailing inside the receiver by controlling a refrigerant supply to the receiver compressor(s).

15. The method according to claim 3, wherein the compressor unit comprises one or more main compressors connected between an outlet of the evaporator(s) and an inlet of the heat rejecting heat exchanger, and one or more receiver compressors connected between a gaseous outlet of the receiver and an inlet of the heat rejecting heat exchanger, and wherein the step of controlling the vapour compression system comprises controlling the pressure prevailing inside the receiver by controlling a refrigerant supply to the receiver compressor(s).

16. The method according to claim 4, wherein the compressor unit comprises one or more main compressors connected between an outlet of the evaporator(s) and an inlet of the heat rejecting heat exchanger, and one or more receiver compressors connected between a gaseous outlet of the receiver and an inlet of the heat rejecting heat exchanger, and wherein the step of controlling the vapour compression system comprises controlling the pressure prevailing inside the receiver by controlling a refrigerant supply to the receiver compressor(s).

17. The method according to claim 2, wherein the vapour compression system further comprises an ejector, an outlet of the heat rejecting heat exchanger being connected to a primary inlet of the ejector, an outlet of the ejector being connected to the receiver, and an outlet of the evaporator(s) being connected to an inlet of the compressor unit and to a secondary inlet of the ejector.

18. The method according to claim 3, wherein the vapour compression system further comprises an ejector, an outlet of the heat rejecting heat exchanger being connected to a primary inlet of the ejector, an outlet of the ejector being connected to the receiver, and an outlet of the evaporator(s) being connected to an inlet of the compressor unit and to a secondary inlet of the ejector.

19. The method according to claim 4, wherein the vapour compression system further comprises an ejector, an outlet of the heat rejecting heat exchanger being connected to a primary inlet of the ejector, an outlet of the ejector being connected to the receiver, and an outlet of the evaporator(s) being connected to an inlet of the compressor unit and to a secondary inlet of the ejector.

20. The method according to claim 5, wherein the vapour compression system further comprises an ejector, an outlet of the heat rejecting heat exchanger being connected to a primary inlet of the ejector, an outlet of the ejector being connected to the receiver, and an outlet of the evaporator(s) being connected to an inlet of the compressor unit and to a secondary inlet of the ejector.

* * * * *